US010115553B1

(12) United States Patent
Chen et al.

(10) Patent No.: US 10,115,553 B1
(45) Date of Patent: Oct. 30, 2018

(54) GROUND FAULT CIRCUIT INTERRUPTER AND RESET MECHANISM THEREOF

(71) Applicant: ZHANGJIAGANG CITY BAREP ELECTRICAL TECHNOLOGY CO., LTD., Zhangjiagang, Jiangsu Province (CN)

(72) Inventors: Jiangang Chen, Zhangjiagang (CN); Zhenjun Yin, Zhangjiagang (CN)

(73) Assignee: ZHANGJIAGANG CITY BAREP ELECTRICAL TECHNOLOGY CO., LTD., ZhangJiagang (CN)

( * ) Notice: Subject to any disclaimer, the term of this patent is extended or adjusted under 35 U.S.C. 154(b) by 6 days.

(21) Appl. No.: 15/805,734

(22) Filed: Nov. 7, 2017

(30) Foreign Application Priority Data

Jul. 14, 2017 (CN) ..... 2017 1 0576587

(51) Int. Cl.

| | |
|---|---|
| ***H01H 73/00*** | (2006.01) |
| ***H01H 71/58*** | (2006.01) |
| ***H01H 71/02*** | (2006.01) |
| ***H01H 71/68*** | (2006.01) |

(52) U.S. Cl.
CPC ..... *H01H 71/58* (2013.01); *H01H 71/0207* (2013.01); *H01H 71/68* (2013.01); *H01H 2235/01* (2013.01)

(58) Field of Classification Search
CPC ..... H01H 50/02; H01H 50/38; H01H 50/54; H01H 2205/002
USPC ..... 335/18
See application file for complete search history.

(56) References Cited

U.S. PATENT DOCUMENTS

| | | | | |
|---|---|---|---|---|
| 5,933,063 | A * | 8/1999 | Keung | H01H 83/20 335/177 |
| 6,437,700 | B1 * | 8/2002 | Herzfeld | H01H 73/14 335/18 |
| 6,477,022 | B1 * | 11/2002 | Ennis | H01H 89/06 335/18 |
| 6,771,152 | B2 * | 8/2004 | Germain | H01H 83/04 335/18 |
| 6,930,574 | B2 * | 8/2005 | Gao | H01R 13/7135 335/18 |
| 6,946,935 | B2 * | 9/2005 | Wu | H01H 83/04 335/18 |
| 6,949,994 | B2 * | 9/2005 | Germain | H01H 83/04 335/18 |
| 7,049,910 | B2 * | 5/2006 | Campolo | G01R 31/041 335/172 |

(Continued)

*Primary Examiner* — Shawki S Ismail
*Assistant Examiner* — Lisa Homza
(74) *Attorney, Agent, or Firm* — Oliff PLC

(57) ABSTRACT

A reset mechanism includes: a reset button, electromagnet, and reset mounting bracket, where a rotary lifting block is movably on the bracket; lifting parts are separately at two sides of one end of the block, and a clamping hook is the other end; a lifting block spring is on one side of the lifting part of the block; a position-limiting block matched with the block is on the bracket, which has a slide rocker in a movable manner; a rocker bending part is at a tail of the slide rocker; an end part of the rocker bending part has a rocker bayonet; an iron core of the electromagnet has an iron core card slot matched with the bayonet, which is clamped to the iron core card slot; and a bottom of the reset button has a reset lever matched with one side of the clamping hook of the block.

9 Claims, 3 Drawing Sheets

(56) References Cited

U.S. PATENT DOCUMENTS 7,049,911 B2 * 5/2006 Germain ..... H01H 83/04 335/18
7,195,500 B2 * 3/2007 Huang ..... H01H 71/123 335/18
7,265,956 B2 * 9/2007 Huang ..... H01H 83/04 335/18
7,271,987 B1 * 9/2007 Zhang ..... H01H 83/14 335/18
7,307,821 B2 * 12/2007 Wang ..... H01H 83/04 335/18
7,317,600 B2 * 1/2008 Huang ..... H01H 71/123 335/18
7,414,499 B2 * 8/2008 Germain ..... H01H 83/04 335/18
7,439,832 B1 * 10/2008 Radosavljevic ..... H01H 23/168 335/18
7,498,909 B2 * 3/2009 Zhang ..... H01H 83/04 335/116
7,538,993 B2 * 5/2009 Huang ..... H01H 71/123 335/18
7,558,034 B2 * 7/2009 Bonasia ..... H01H 83/04 335/10
7,612,973 B2 * 11/2009 Germain ..... H01H 83/04 335/18
7,737,809 B2 * 6/2010 Germain ..... H01H 83/04 335/18
8,222,978 B2 * 7/2012 Ku ..... H01H 83/02 335/177
2002/0196109 A1 * 12/2002 DiSalvo ..... H01H 83/04 335/18
2005/0024170 A1 * 2/2005 Germain ..... H01H 83/04 335/18
2005/0264383 A1 * 12/2005 Zhang ..... H01H 83/04 335/18
2006/0044086 A1 * 3/2006 Wang ..... H01H 83/02 335/18
2006/0044087 A1 * 3/2006 Wang ..... H01H 83/04 335/18
2006/0139132 A1 * 6/2006 Porter ..... H01H 83/04 335/18
2007/0229202 A1 * 10/2007 Gao ..... H01H 9/161 335/18
2008/0094765 A1 * 4/2008 Huang ..... H01H 83/04 361/42
2008/0112099 A1 * 5/2008 Li ..... H01H 83/04 361/42
2008/0192393 A1 * 8/2008 Huang ..... H01H 71/04 361/45
2009/0256661 A1 * 10/2009 Li ..... H01H 83/04 335/18
2010/0259347 A1 * 10/2010 Ziegler ..... H01H 83/04 335/14
2013/0021120 A1 * 1/2013 Chen ..... H01H 73/44 335/18
2013/0241677 A1 * 9/2013 Padro ..... H01H 83/144 335/18
2013/0241678 A1 * 9/2013 Bonasia ..... H01H 83/04 335/18

* cited by examiner

GROUND FAULT CIRCUIT INTERRUPTER AND RESET MECHANISM THEREOF

BACKGROUND

Technical Field

The present invention relates to a power socket, and in particular, to a ground fault circuit interrupter (GFCI for short in English).

Related Art

As is known to all, a reset mechanism of a current GFCI is relatively complex, and a structure thereof usually includes: a lock mounting bracket mounted on a primary circuit board, a lifting chute surrounded by four columns and disposed in the lock mounting bracket, a lifting slider disposed in the lifting chute in a movable manner, a reset lever hole through from top to bottom disposed in the lifting slider, an upper reset spring hole located on an upper bead of the reset lever hole, and a lower reset spring hole located on a lower bead of the reset lever hole, where a top of the lower reset spring is inserted into the lower reset spring hole; a bottom of the lower reset spring abuts against the lock mounting bracket; a bottom of the upper reset spring is inserted into the upper reset spring hole; a top of the upper reset spring abuts against a mounting middle frame; a front of the lifting slider is provided with a press part matched with a micro switch; a lifting part is separately disposed at a left side and a right side of the lifting slider; a lock socket through from front to back is disposed facing towards the reset lever hole on the lifting slider and above the press part; a lock is disposed in the lock socket in a sliding manner; an end part of the lock is clamped into a circular groove of an end part of an iron core of an electromagnet in a movable manner; and an oblong hole corresponding to the reset lever hole is disposed on the lock. In a practical production process, assembling is hard to implement, greatly affecting assembly efficiency and increasing production costs.

SUMMARY

The technical problem to be resolved in the present invention is: to provide a reset mechanism of a GFCI, which is simply structured and easy to assemble.

To resolve the foregoing technical problem, the present invention provides a technical solution: a reset mechanism of a GFCI, including: a reset button, an electromagnet, a slide rocker, a rotary lifting block, and a reset mounting bracket, where a reset lever is disposed at a bottom of the reset button; rotating shafts are separately disposed at two sides of the rotary lifting block; the rotary lifting block is disposed on the reset mounting bracket in a movable manner by using the pair of rotating shafts; lifting parts protruding outwards are separately disposed at two sides of one end of the rotary lifting block; a clamping hook facing inwards is disposed on a bottom surface of another end of the rotary lifting block; a lifting block spring used for resetting the rotary lifting block is disposed on one side of the lifting part of the rotary lifting block; a bottom of the lifting block spring abuts against the rotary lifting block; a position-limiting block matched with one side of the lifting part of the rotary lifting block is disposed on the reset mounting bracket; the reset mounting bracket is provided with a rocker insertion hole matched with the slide rocker below the rotary lifting block; the slide rocker penetrates the rocker insertion hole in a movable manner; the slide rocker is provided with a rocker bending part on an end part of one side of the lifting part of the rotary lifting block; an end part of the rocker bending part is provided with a rocker bayonet; the electromagnet is disposed at one side of the rocker bending part of the slide rocker; an iron core of the electromagnet is provided with an iron core card slot matched with the rocker bayonet; the rocker bayonet is clamped to the iron core card slot of the iron core; the reset lever is disposed above one side of the clamping hook of the rotary lifting block in a movable manner; and a reset lever spring used for resetting the reset button is sleeved on the reset lever. As a preferred solution, in the reset mechanism of the GFCI, a spring support corresponding to the lifting block spring is disposed on the rotary lifting block, and a bottom of the lifting block spring is sleeved on the spring support.

As a preferred solution, in the reset mechanism of the GFCI, the reset mounting bracket is provided with a pair of rotating shaft insertion holes that correspond to the rotating shafts of the rotary lifting block one to one and that face upwards and are greater than a semicircle, and the rotating shafts of the rotary lifting block are clamped into the corresponding rotating shaft insertion holes in a one-to-one correspondence manner.

The present invention provides the GFCI that is simply structured and easy to assemble, including: an enclosure composed of a bottom case and an upper cover disposed on the bottom case, where the enclosure is provided with a primary circuit board, a pair of induction coils, a pair of input end connecting plates, a pair of input terminals, a ground bracket, a test button, a mounting middle frame, a tact switch composed of a stationary contact switch reed and a moving contact switch reed, and the reset mechanism according to the present invention, where an upper end of the lifting block spring abuts against the mounting middle frame; the reset mounting bracket is respectively provided with a stationary contact reed through hole and a moving contact reed through hole matched with the stationary contact switch reed and the moving contact switch reed; the electromagnet is mounted on the primary circuit board; the primary circuit board is further provided with an induction coil enclosure and an induction coil positioning rod disposed in the induction coil enclosure; the pair of induction coils are sleeved onto the induction coil positioning rod; a coil separator is disposed between the pair of induction coils; the positioning rod is provided with a pair of induction jacks disposed in a longitudinal manner; an input end bending part is disposed at each input end of the pair of input end connecting plates; the input end bending part is inserted into a corresponding induction jack; output ends of the pair of input end connecting plates are separately disposed above the lifting part of a corresponding side of the rotary lifting block; a group of strong-current plug-in plates are disposed in the mounting middle frame; at least one strong-current plug-in reed is disposed on each strong-current plug-in plate; a strong-current connecting contact corresponding to an output ends of a corresponding input end connecting plate is disposed on a back surface of each strong-current plug-in plate; a ground plug-in reed is disposed on the ground bracket; the upper cover is separately provided with a strong-current jack and a ground jack respectively corresponding to the strong-current plug-in reed and the ground plug-in reed; the upper cover is further provided with a reset hole and a test hole respectively used for inserting the reset button and the test button; an upper end of the reset lever spring abuts against the reset button; a lower end of the reset lever spring abuts against the mounting middle frame; the mounting middle frame is provided with a reset lever via corresponding to the reset lever; a lower end of the reset lever passes through the reset lever via of the mounting middle frame and reaches above one side of the clamping hook of the rotary lifting block; a test lever is disposed at a bottom of the test button; the mounting middle frame is further provided with a secondary circuit board connected to the primary circuit board; a test switch plate is disposed on one strong-current plug-in plate; an end of the test switch plate corresponds to a test point of the secondary circuit board.

As a preferred solution, in the GFCI, two groups of strong-current plug-in reeds are disposed on the group of strong-current plug-in plates.

As a preferred solution, in the GFCI, the primary circuit board is further provided with load connecting plates corresponding to the pair of input end connecting plates, and corresponding electric connecting contacts are separately disposed on the load connecting plates and the corresponding input end connecting plates.

As a preferred solution, in the GFCI, a specific mounting structure of the electromagnet includes: an electromagnet coil bracket being mounted on the primary circuit board; an electromagnet coil being wound around the electromagnet coil bracket; the iron core of the electromagnet penetrating the electromagnet coil in a movable manner by using the electromagnet coil bracket; and an iron core reset spring being disposed between the iron core of the electromagnet and the bottom case.

Beneficial effects of the present invention are: the reset mechanism of the present invention has a very simple structural design, making the reset mechanism, even the whole GFCI very convenient to assemble, thus greatly improving assembly efficiency and reducing production costs. In addition, production costs are further reduced for using a tact switch composed of a stationary contact switch reed and a moving contact switch reed.

Figure 1:
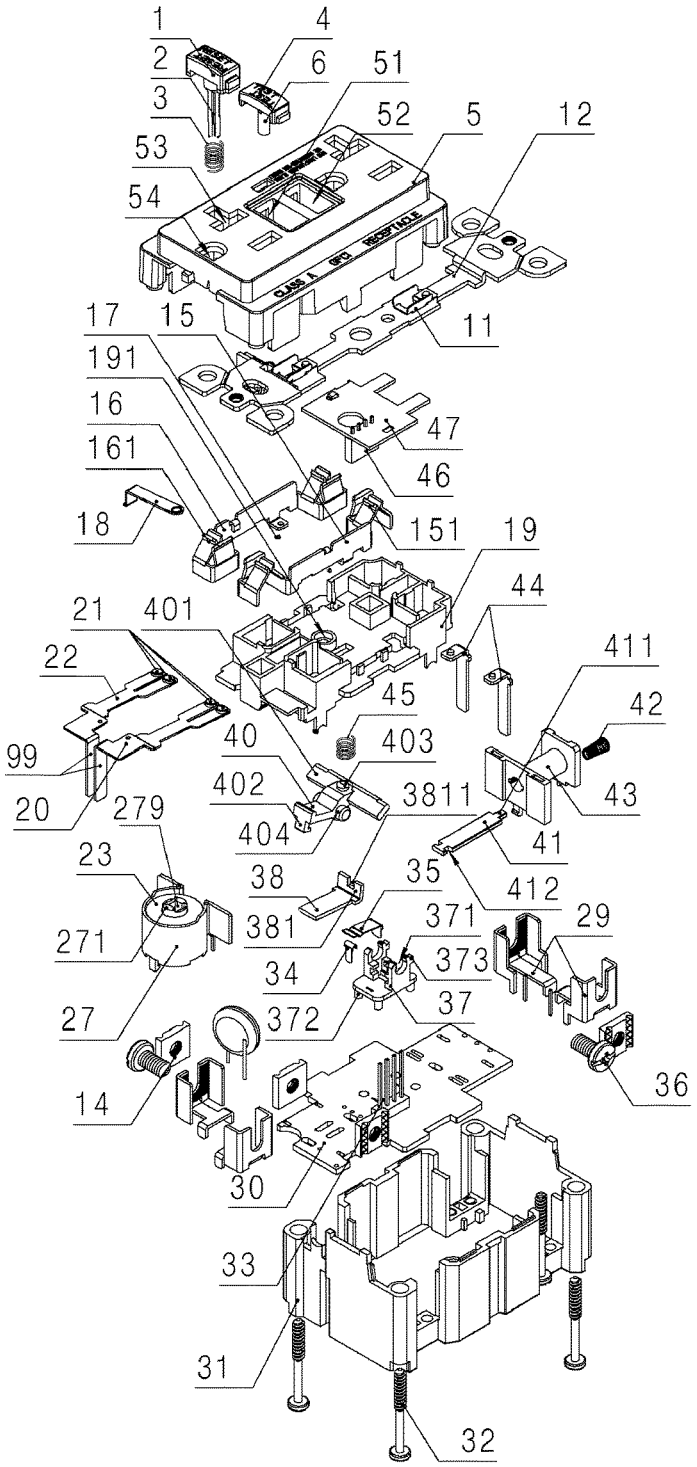
FIG. 1 is an exploded schematic structural diagram of a GFCI according to the present invention.
Figure 2:
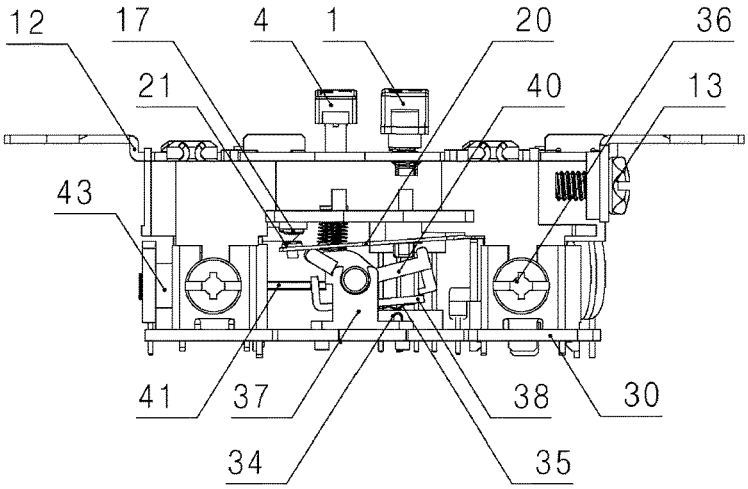
FIG. 2 is a partial schematic structural diagram according to the present invention.
Figure 3:
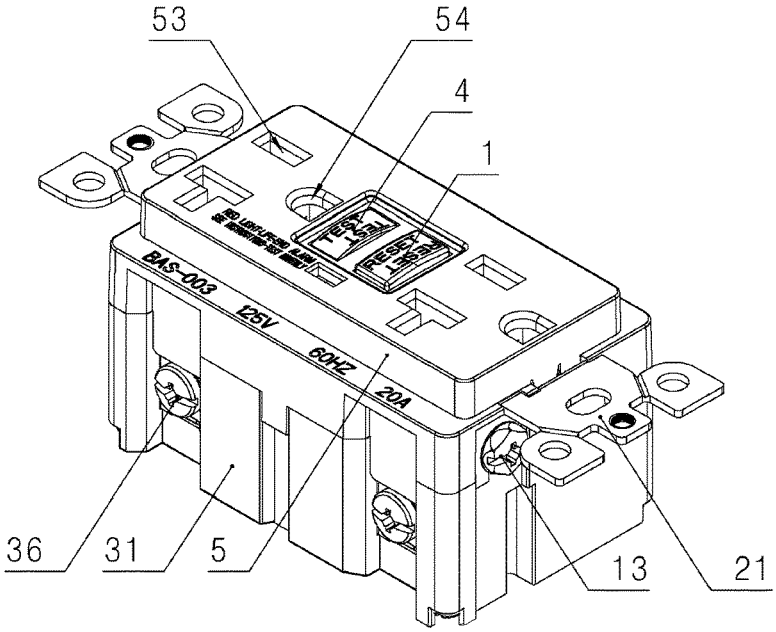
FIG. 3 is a schematic stereo-structural diagram according to the present invention.

Reference numerals in FIG. 1 to FIG. 3 are: 1. reset button, 2. reset lever, 3. reset lever spring, 4. test button, 5. upper cover, 51. reset hole, 52. test hole, 53. strong-current jack, 54. ground jack, 6. test lever, 11. ground plug-in reed, 12. ground bracket, 13. terminal screw, 14. cord, 15. first strong-current plug-in plate, 151. first strong-current plug-in reed, 16. second strong-current plug-in plate, 161. second strong-current plug-in reed, 17. stationary contact, 18. test switch plate, 19. mounting middle frame, 191. reset lever via, 20. second input end connecting plate, 21. moving contact, 22. first input end connecting plate, 23. coil cover, 27. induction coil enclosure, 271. induction coil positioning rod, 29. input terminal, 30. primary circuit board, 31. bottom case, 32. tapping screw, 33. male socket, 34. stationary contact switch reed, 35. moving contact switch reed, 36. terminal screw, 37. reset mounting bracket, 371. positioning rod, 372. rotating shaft insertion hole, 373. position-limiting block, 38. slide rocker, 381. rocker bending part, 3811. rocker bayonet, 40. rotary lifting block, 401. lifting part, 402. clamping hook, 403. spring support, 404. rotating shaft, 41. iron core, 411. protruding boss, 412. iron core card slot, 42. iron core reset spring, 43. electromagnet coil bracket, 44. load connecting plate, 45. lifting block spring, 46. female socket, 47. secondary circuit board.

DETAILED DESCRIPTION

Specific implementations of a GFCI according to the present invention are described below in detail with reference to the accompanying drawings.

As shown in FIG. 1 and FIG. 3, a structure of a GFCI according to the present invention includes: an enclosure composed of a plastic bottom case 31 and an upper cover 5. The enclosure is provided with a primary circuit board 30, a second input end connecting plate 20, a first input end connecting plate 22, a pair of input terminals 29, a ground bracket 12, a mounting middle frame 19, a test button 4, a reset mechanism, and a tact switch composed of a stationary contact switch reed 34 and a moving contact switch reed 35. As shown in FIG. 2, the reset mechanism includes: a reset button 1, an electromagnet, a slide rocker 38, a rotary lifting block 40, and a plastic reset mounting bracket 37 mounted on the primary circuit board 30. A specific mounting manner of the reset mounting bracket 37 is that: four positioning rods 371 are disposed at a bottom of the reset mounting bracket 37; the primary circuit board 30 is provided with mounting holes corresponding to the four positioning rods 371 one to one; the positioning rods 371 of the reset mounting bracket 37 penetrate the mounting holes of the primary circuit board 30 in a one-to-one correspondence manner and fasten the reset mounting bracket 37 onto the primary circuit board 30 by pressing end parts of the positioning rods 371; the rotary lifting block 40 is disposed on the reset mounting bracket 37 in a movable manner, and a specific mounting manner is that: a rotating shaft 404 is separately disposed at two sides of the rotary lifting block 40; a top of the reset mounting bracket 37 is provided with a rotating groove matched with the rotary lifting block 40; two side walls of the rotating groove are separately provided with a rotating shaft insertion hole 372 that faces upwards and is greater than a semicircle; a pair of rotating shafts 404 of the rotary lifting block 40 are clamped into the corresponding rotating shaft insertion holes 372 of the reset mounting bracket 37 in a one-to-one correspondence manner; lifting parts 401 protruding outwards are separately disposed at two sides of one end of the rotary lifting block 40; a clamping hook 402 facing inwards is disposed on a bottom surface of another end of the rotary lifting block 40; a spring support 403 is disposed on one side of the lifting part 401 of the rotary lifting block 40; a lifting block spring 45 used for resetting the rotary lifting block 40 is disposed on the spring support 403; a bottom of the lifting block spring 45 abuts against the rotary lifting block 40; a top of the lifting block spring 45 abuts against the mounting middle frame 19; a position-limiting block 373 matched with one side of the lifting part of the rotary lifting block 40 is disposed on the reset mounting bracket 37; the reset mounting bracket 37 is provided with a rocker insertion hole matched with the slide rocker 38 below the rotary lifting block 40; the slide rocker 38 penetrates the rocker insertion hole in a movable manner; the slide rocker 38 is provided with a rocker bending part 381 facing upwards on an end part of one side of the lifting part of the rotary lifting block 40; a bottom end of the rocker bending part 381 is provided with a rocker bayonet 3811 facing upwards; the electromagnet is disposed at one side of the rocker bending part 381 of the slide rocker 38, and a specific mounting manner of the electromagnet includes: an iron core 41 of the electromagnet and an electromagnet coil bracket 43 used for mounting an electromagnet coil, where the electromagnet coil is diffracted on the electromagnet coil bracket 43 (belonging to a common technology of the field, not shown in figures); the iron core 41 of the electromagnet penetrates the electromagnet coil by using the electromagnet coil bracket 43 in a movable manner; a protruding boss 411 indenting inwards is disposed at a tail of the iron core 41 of the electromagnet; an iron core reset spring 42 is sleeved on the protruding boss 411; one end of the iron core reset spring 42 abuts against a shoulder of the protruding boss 411; another end of the iron core reset spring 42 abuts against the bottom case 31; another end of the iron core 41 is provided with an iron core card slot 412 matched with the rocker bayonet 3811; the rocker bayonet 3811 is clamped to the iron core card slot 412 of the iron core 41; a reset lever 2 is disposed at a bottom of the reset button 1; a reset lever spring 3 is sleeved on the reset lever 2; an upper end of the reset lever spring 3 abuts against the reset button 1; a lower end of the reset lever spring 3 abuts against the mounting middle frame 19; the mounting middle frame 19 is provided with a reset lever via corresponding to the reset lever 2; a lower end of the reset lever 2 passes through the reset lever via of the mounting middle frame 19 and reaches above one side of the clamping hook 402 of the rotary lifting block 40; the primary circuit board 30 is further provided with an induction coil enclosure 27 and an induction coil positioning rod 271 disposed in the induction coil enclosure 27; the induction coil positioning rod 271 is correspondingly, from bottom to top, sleeved with a first induction coil, a coil separator, a second induction coil and a coil cover 23 (the first induction coil, the coil separator, and the second induction coil belong to a common technology of the field, not shown in figures); the induction coil positioning rod 271 is provided with a pair of induction jacks 279 disposed in a longitudinal manner; a bending part 99 is disposed at each input end of a first input end connecting plate 22 and a second input end connecting plate 20; a moving contact 21 is disposed at each output end of the first input end connecting plate 22 and the second input end connecting plate 20; the bending part of the first input end connecting plate 22 and the second input end connecting plate 20 is inserted into a corresponding induction jack 279; output ends of the first input end connecting plate 22 and the second input end connecting plate 20 are separately disposed above the lifting part 401 of a corresponding side of the rotary lifting block 40; a group of strong-current plug-in plates, a first strong-current plug-in plate 15 and a second strong-current plug-in plate 16, are disposed in the mounting middle frame 19; two first strong-current plug-in reeds 151 are disposed on the first strong-current plug-in plate 15; two second strong-current plug-in reeds 161 are disposed on the second strong-current plug-in plate 16; a strong-current connecting contact, that is, a stationary contact 17, corresponding to the moving contact 21 of the output ends of the corresponding first input end connecting plate 22 and second input end connecting plate 20 is disposed on a back surface of the first strong-current plug-in plate 15 and the second strong-current plug-in plate 16; a pair of ground plug-in reeds 11 are disposed on the ground bracket 12; as shown in FIG. 3, the upper cover 5 is separately provided with a strong-current jack 53 corresponding to the two first strong-current plug-in reed 151 and the two second strong-current plug-in reed 161 and a ground jack 54 corresponding to the pair of ground plug-in reeds 11; the upper cover is further provided with a reset hole 51 and a test hole 52 respectively used for inserting the reset button 1 and the test button 4; a test lever 6 is disposed at a bottom of the test button 4; the mounting middle frame 19 is further provided with a secondary circuit board 47 connected to the primary circuit board 30 by using a male rocket 33 and a female rocket 46; a test switch plate 18 is disposed on one strong-current plug-in plate; an end part of the test switch plate 18 corresponds to a test point of the secondary circuit board 47; and the test lever 6 directly faces the test switch plate 18. In the embodiment, four tapping screws 32, certain terminal screws 13, and certain cords 14 are further included.

Figure 4:
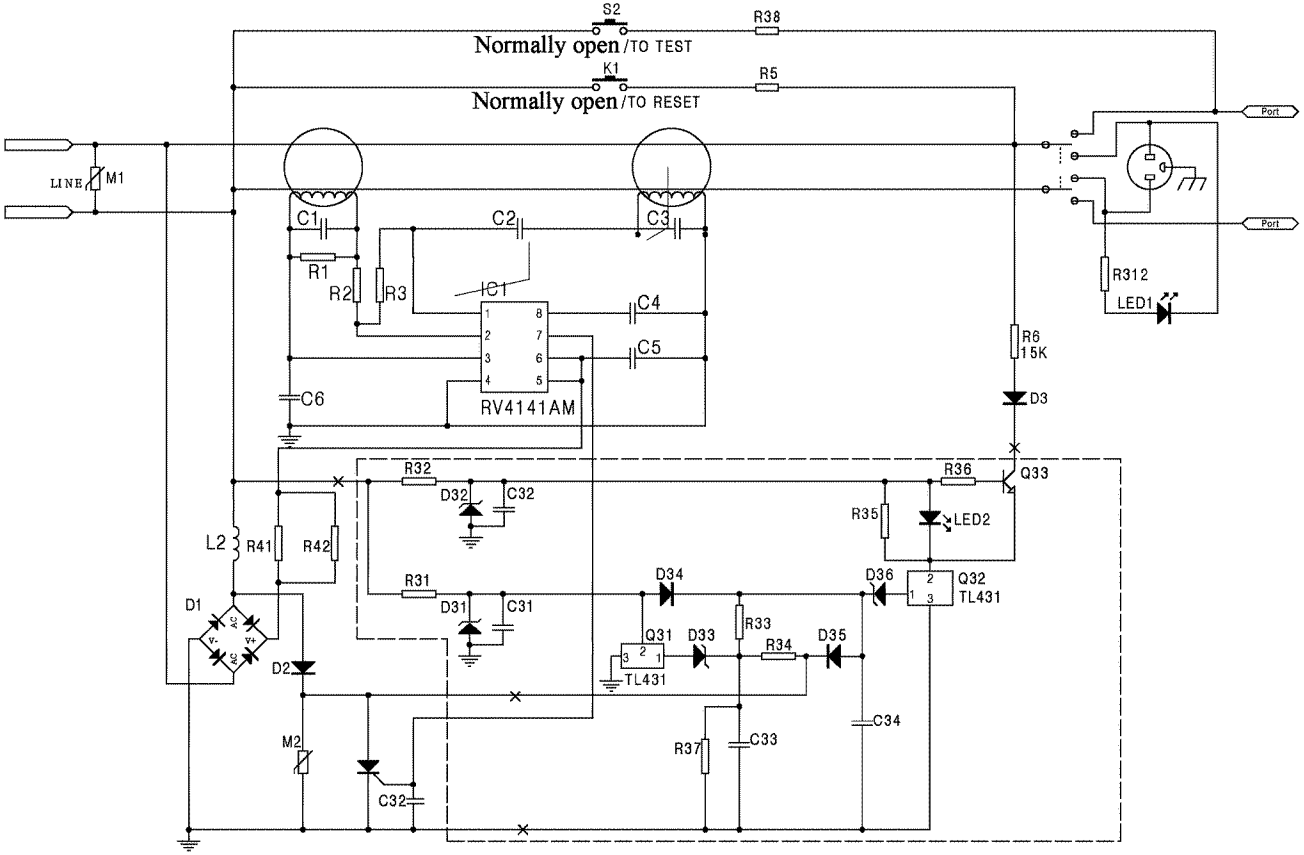
FIG. 4 is an electrical principle diagram of main and secondary circuit boards according to the present invention.

In practical application, the primary circuit board 30 is further provided with a pair of load connecting plates 44 respectively corresponding to the first input end connecting plate 22 and the second input end connecting plate 20, and corresponding electric connecting contacts, that is, stationary contacts, are separately disposed on the load connecting plates 44 and the corresponding first input end connecting plate 22 and second input end connecting plate 20. A circuit as shown in FIG. 4 is mounted on the primary circuit board 30 and the secondary circuit board 47.

During using, a right end of the slide rocker 38 moves downwards when the reset button 1 is pressed. The moving contact switch reed 35 is pressed to approach the stationary contact switch reed 34 until the stationary contact switch reed 34 is in contact with the moving contact switch reed 35. In this case, under control of the circuit shown in FIG. 4, the iron core 41 of the electromagnet drives the slide rocker 38 to indent, so that the clamping hook 402 on the rotary lifting block 40 crosses the slide rocker 38. Then, the iron core 41 of the electromagnet extends forwards, so that the clamping hook 402 on the rotary lifting block 40 is hooked on the slide rocker 38. When the rotary lifting block 40 needs to reset, the iron core 41 of the electromagnet only needs to drive the slide rocker 38 to indent, so that the clamping hook 402 escapes control of the slide rocker 38. In this way, the rotary lifting block 40 rotates counterclockwise under the action of the lifting block spring 45 and finally abuts against the position-limiting block 373 of the reset mounting bracket 37.

Based on the above, the foregoing descriptions are merely preferred embodiments of the present invention, but are not intended to limit the present invention. Any equivalent modification and improvement of shapes, constructions, features, and spirits made according to the claims of the present invention shall fall within the claims of the present invention.

What is claimed is:

1. A reset mechanism of a ground fault circuit interrupter (GFCI), comprising: a reset button and a reset lever disposed at a bottom of the reset button, wherein the reset mechanism further comprises: an electromagnet, a slide rocker, a rotary lifting block, and a reset mounting bracket, wherein rotating shafts are separately disposed at two sides of the rotary lifting block; the rotary lifting block is disposed on the reset mounting bracket in a movable manner by using the pair of rotating shafts; lifting parts protruding outwards are separately disposed at two sides of one end of the rotary lifting block; a clamping hook facing inwards is disposed on a bottom surface of another end of the rotary lifting block; a lifting block spring used for resetting the rotary lifting block is disposed on one side of the lifting part of the rotary lifting block; a bottom of the lifting block spring abuts against the rotary lifting block; a position-limiting block matched with one side of the lifting part of the rotary lifting block is disposed on the reset mounting bracket; the reset mounting bracket is provided with a rocker insertion hole matched with the slide rocker below the rotary lifting block; the slide rocker penetrates the rocker insertion hole in a movable manner; the slide rocker is provided with a rocker bending part on an end part of one side of the lifting part of the rotary lifting block; an end part of the rocker bending part is provided with a rocker bayonet; the electromagnet is disposed at one side of the rocker bending part of the slide rocker; an iron core of the electromagnet is provided with an iron core card slot matched with the rocker bayonet; the rocker bayonet is clamped to the iron core card slot of the iron core; the reset lever is disposed above one side of the clamping hook of the rotary lifting block in a movable manner; and a reset lever spring used for resetting the reset button is sleeved on the reset lever.

2. The reset mechanism of the GFCI according to claim 1, wherein a spring support corresponding to the lifting block spring is disposed on the rotary lifting block, and a bottom of the lifting block spring is sleeved on the spring support.

3. The reset mechanism of the GFCI according to claim 1, wherein the reset mounting bracket is provided with a pair of rotating shaft insertion holes that correspond to the rotating shafts of the rotary lifting block one to one and that face upwards and are greater than a semicircle, and the rotating shafts of the rotary lifting block are clamped into the corresponding rotating shaft insertion holes in a one-to-one correspondence manner.

4. The ground fault circuit interrupter (GFCI), comprising: an enclosure composed of a bottom case and an upper cover disposed on the bottom case, wherein the enclosure disposes a primary circuit board, a pair of induction coils, a pair of input end connecting plates, a pair of input terminals, a ground bracket, a test button, a mounting middle frame, a tact switch composed of a stationary contact switch reed and a moving contact switch reed, and the reset mechanism according to claim 1, wherein an upper end of the lifting block spring abuts against the mounting middle frame; the reset mounting bracket is respectively provided with a stationary contact reed through hole and a moving contact reed through hole matched with the stationary contact switch reed and the moving contact switch reed; the electromagnet is mounted on the primary circuit board; the primary circuit board is further provided with an induction coil enclosure and an induction coil positioning rod disposed in the induction coil enclosure; the pair of induction coils are sleeved onto the induction coil positioning rod; a coil separator is disposed between the pair of induction coils; the positioning rod is provided with a pair of induction jacks disposed in a longitudinal manner; an input end bending part is disposed at each input end of the pair of input end connecting plates; the input end bending part is inserted into a corresponding induction jack; output ends of the pair of input end connecting plates are separately disposed above the lifting part of a corresponding side of the lifting slider; a group of strong-current plug-in plates are disposed in the mounting middle frame; at least one strong-current plug-in reed is disposed on each strong-current plug-in plate; a strong-current connecting contact corresponding to an output end of a corresponding input end connecting plate is disposed on a back surface of each strong-current plug-in plate; a ground plug-in reed is disposed on the ground bracket; the upper cover is separately provided with a strong-current jack and a ground jack respectively corresponding to the strong-current plug-in reed and the ground plug-in reed; the upper cover is further provided with a reset hole and a test hole respectively used for inserting the reset button and the test button; an upper end of the reset lever spring abuts against the reset button; a lower end of the reset lever spring abuts against the mounting middle frame; the mounting middle frame is provided with a reset lever via corresponding to the reset lever; a lower end of the reset lever passes through the reset lever via of the mounting middle frame and reaches above one side of the clamping hook of the rotary lifting block; a test lever is disposed at a bottom of the test button; the mounting middle frame is further provided with a secondary circuit board connected to the primary circuit board; a test switch plate is disposed on one strong-current plug-in plate; and an end part of the test switch plate corresponds to a test point of the secondary circuit board.

5. The GFCI according to claim 1, wherein two groups of strong-current plug-in reeds are disposed on the group of strong-current plug-in plates.

6. The GFCI according to claim 5, wherein a specific mounting structure of the electromagnet comprises: an electromagnet coil bracket being mounted on the primary circuit board; an electromagnet coil being wound around the electromagnet coil bracket; the iron core of the electromagnet penetrating the electromagnet coil in a movable manner by using the electromagnet coil bracket; and an iron core reset spring being disposed between the iron core of the electromagnet and the bottom case.

7. The GFCI according to claim 1, wherein the primary circuit board is further provided with load connecting plates corresponding to the pair of input end connecting plates, and corresponding electric connecting contacts are separately disposed on the load connecting plates and the corresponding input end connecting plates.

8. The GFCI according to claim 7, wherein a specific mounting structure of the electromagnet comprises: an electromagnet coil bracket being mounted on the primary circuit board; an electromagnet coil being wound around the electromagnet coil bracket; the iron core of the electromagnet penetrating the electromagnet coil in a movable manner by using the electromagnet coil bracket; and an iron core reset spring being disposed between the iron core of the electromagnet and the bottom case.

9. The GFCI according to claim 4, wherein a specific mounting structure of the electromagnet comprises: an electromagnet coil bracket being mounted on the primary circuit board; an electromagnet coil being wound around the electromagnet coil bracket; the iron core of the electromagnet penetrating the electromagnet coil in a movable manner by using the electromagnet coil bracket; and an iron core reset spring being disposed between the iron core of the electromagnet and the bottom case.

* * * * *